US005088236A

United States Patent [19]

Karhu

[11] Patent Number: 5,088,236

[45] Date of Patent: Feb. 18, 1992

[54] PIVOTABLE GLAZING FOR A BALCONY

[75] Inventor: Niilo Karhu, Vantaa, Finland

[73] Assignee: Lemminkainen OY, Helsinki, Finland

[21] Appl. No.: 476,406

[22] PCT Filed: Dec. 8, 1988

[86] PCT No.: PCT/FI88/00197

§ 371 Date: Aug. 9, 1990

§ 102(e) Date: Aug. 9, 1990

[87] PCT Pub. No.: WO89/05389

PCT Pub. Date: Jun. 15, 1989

[30] Foreign Application Priority Data

Dec. 9, 1987 [FI] Finland ..... 875416

[51] Int. Cl.[5] ..... E05D 15/26

[52] U.S. Cl. ..... 49/127; 49/125; 49/410

[58] Field of Search ..... 49/125, 127, 128, 130, 49/409, 410, 411

[56] References Cited

U.S. PATENT DOCUMENTS

| | | | |
|---|---|---|---|
| 963,752 | 7/1910 | Duner | 49/125 |
| 3,309,816 | 3/1967 | Malone | 49/127 |
| 3,394,496 | 7/1968 | Pulaski | 49/127 |
| 3,397,487 | 8/1968 | Hunt et al. | 49/130 |
| 3,755,968 | 9/1973 | Williams | 49/127 X |
| 3,990,183 | 11/1976 | Meggs et al. | 49/125 |
| 4,388,778 | 6/1983 | Brooke | 49/125 |
| 4,438,594 | 3/1984 | Bunzl | 49/125 X |

FOREIGN PATENT DOCUMENTS

| | | | |
|---|---|---|---|
| 289533 | 1/1916 | Fed. Rep. of Germany | 49/125 |
| 278802 | 5/1962 | Netherlands | 49/127 |
| 91792 | 11/1919 | Switzerland | 49/127 |

OTHER PUBLICATIONS

'The E. F. Hauserman Company'; New Sliding Acoustic: 10/10/1961 pp. 6–10.

*Primary Examiner*—Gary L. Smith
*Assistant Examiner*—Jerry Redman
*Attorney, Agent, or Firm*—Banner, Birch, McKie & Beckett

[57] ABSTRACT

The invention relates to a pivotable glazing for a balcony. There are previously known balcony glazings which comprise four or more panes which move in an overlapping manner on two adjacent tracks. Such a structure requires considerable sealing and frame structures which detract from the outer appearance of the building. Furthermore, the balcony aperture can be opened at maximum 50%, and it is difficult to wash the outer surfaces of the panes. According to the present invention, these disadvantages are eliminated by fitting all the panes of glass adjacently in the same double-rail track. At the upper edge of each movable glass pane (1) there are two slides (3, 4), of which one moves on a straight outer rail and the other on an inner rail, which curves inwards and towards the side wall (13) of the balcony. Within the curved portion (18) of the inner rail the trailing edge of the pane turns inwards and the pane can be opened against the side wall (13) of the balcony. In this manner it is possible to move one or more panes away from the opening of the balcony. The panes can also be pivoted 180°, in which case a heat-reflective surface (19) can be turned so as to face outwards or inwards, according to need. At the lower edge of the pane there are slides, sliding on the lower track, one of the slides separating from the track when the pane turns inwards.

13 Claims, 4 Drawing Sheets

Figure 1:
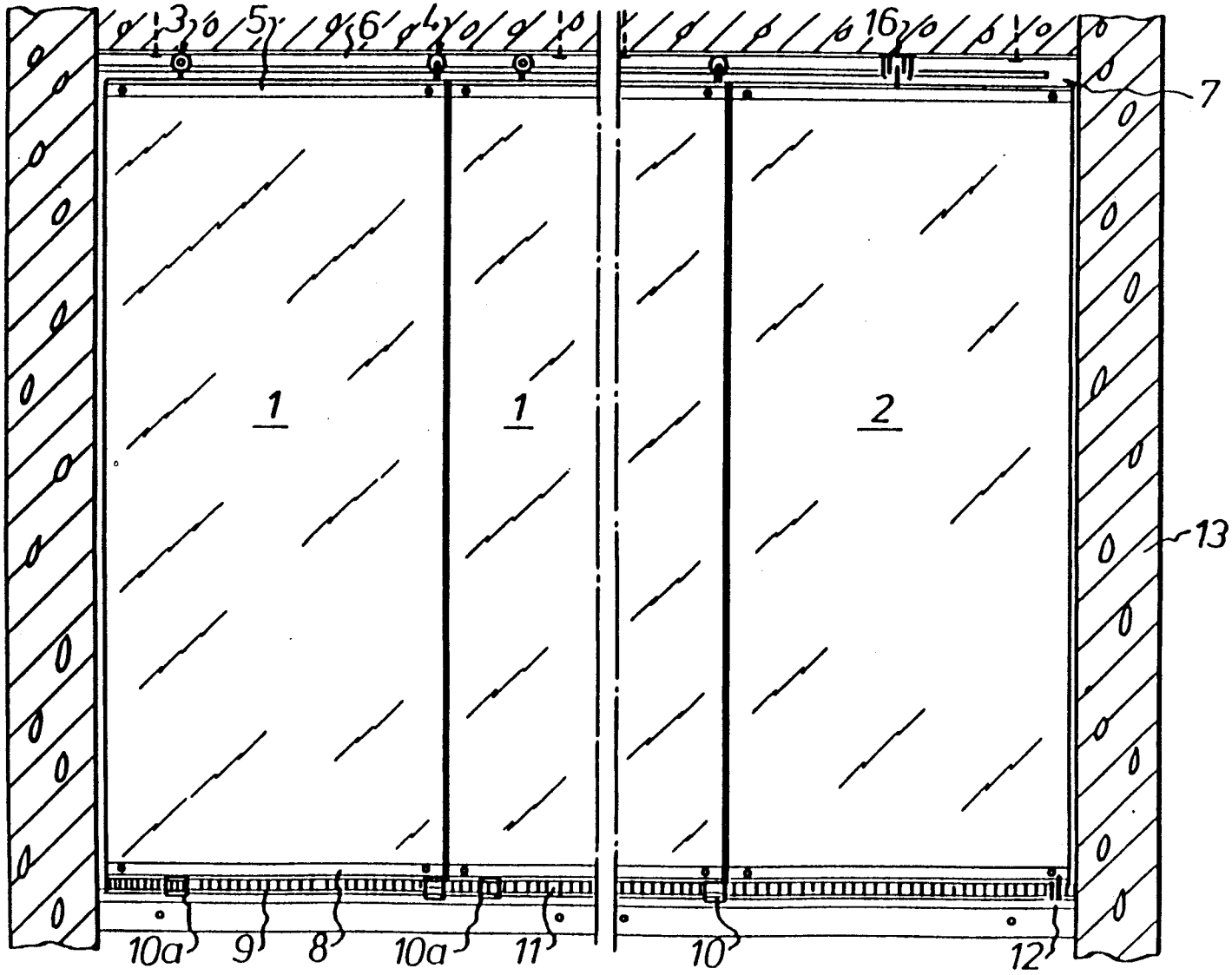

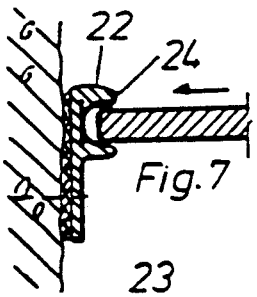
Fig. 7
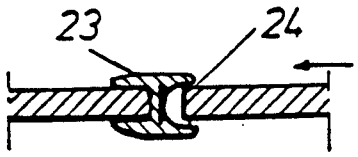
Fig. 8
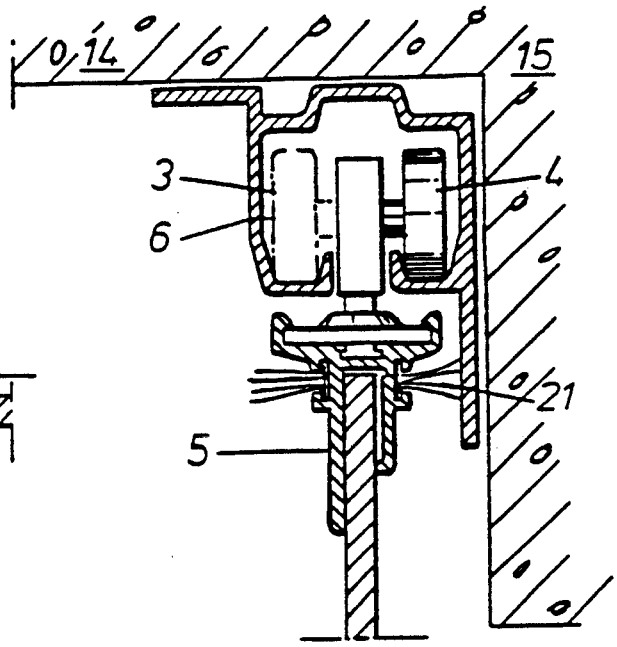
Fig. 4
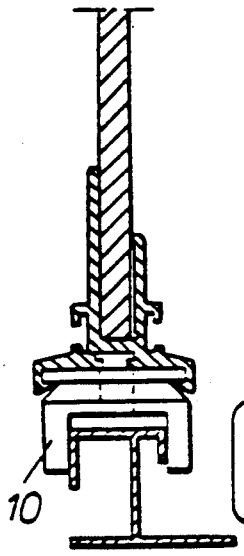
Fig. 5
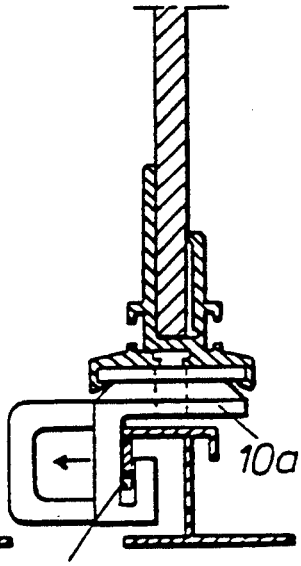
Fig. 6
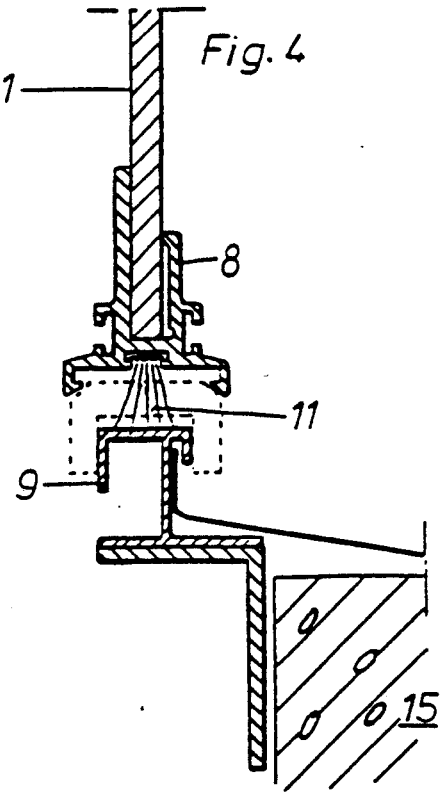

PIVOTABLE GLAZING FOR A BALCONY

The present invention relates to a pivotable glazing for a balcony.

The protecting of balcony spaces with glass is becoming more common. In the northern climate, effective use of an open-air balcony is limited to a rather short summer season. By installing glass panes on the open side of the balcony it is possible to multiply the usability of the balcony. By means of glass panes which cover the open wall opening, the air temperature on the balcony can be increased, and at the same time the penetration of wind, noise and dust into the balcony can be prevented. On the other hand, sunshine may also cause excessive heat in summertime on a balcony facing south or southwest and may thus hamper the use of the balcony, in which case it is advantageous to prevent sun rays from entering the balcony.

In present-day constructions, the glazing of a balcony is made up of four or more panes which slide in an overlapping manner, on two tracks, at the head and the base. Such a construction has several deficiencies:

The front wall of the balcony can be opened at most 50%, in which case excessive heat will constitute a problem in summertime;

the washing of the outside surface of the panes is difficult. The panes must be lifted out of place, which constitutes a risk, or the panes must be washed from the outside, which is also dangerous;

the sealing of overlapping glass surfaces imposes its own requirements, the panes must be equipped with a sturdy frame, in which case the glazing will substantially change the appearance of the facade of the building.

The construction according to the present invention eliminates the above-mentioned disadvantages, and it is characterized primarily by providing panes and side panes which are rotatable about 180° such that the face of the pane can be changed from having been turned outside, and vice-versa.

The construction according to the invention thus has as its starting point a pivotable glazing, which comprises two or more movable panes, preferably covering the entire width of the balcony; these panes slide on upper and lower tracks secured to the ceiling structures and respectively to the balustrade structures of the balcony. At the upper edge of each pane there is a profile having at least two slides at a distance from each other and rotating about their vertical axes; one of these slides runs on the straight outer rail of the upper track and the other one runs on the inner rail, which turns inwards and to the side. At the lower edge of each pane there is a profile having slides rotating about their vertical axes, these slides moving on the lower track of the balcony.

According to the invention, the inner rail of the upper track is curved in shape so that in the main it has approximately the shape of a circle arc the center point of which is close to the corner of the balcony balustrade and the side wall and the radius of which is at maximum equal to the pane width. By means of this arrangement, a pane to be moved can be guided within the curved portion of the inner rail in such a way that the pane surface facing inwards will lead the movement and will settle against the side wall, and further back to the initial position or to a 180° pivoted position, in which the side which originally faced inwards will face outwards. The slide which is at the lower edge of the pane in the turning part of the pane is fitted so as to separate from the lower track when the pane turns inwards from the upper inner rail.

According to a preferred embodiment, the curved rail portion of the inner rail forms a gently curving inverted S-shape. Thus the pivoting movement will consist of a slow, flexible initial turning, an even middle movement which follows the arc of a circle, and finally a slow, turning and pushing movement.

The curved portion of the inner rail is preferably spaced apart from the side wall in such a manner that, when necessary, the panes can be removed.

In a preferred embodiment of the invention, of the slides at the upper edge the one which moves on the outer rail is located at that end or close to that end of the upper edge which is closer to the curved rail portion, and the other slide is located at the other end of the upper edge or at some distance from the other end. Thus the edge leading the movement of the pane will slide along the outer rail all the way to a point close to the side wall, and the opposite edge of the pane will begin to turn inwards when the slide moving on the inner rail arrives at the curved portion.

The slides at the lower edge are preferably located at the two ends of the lower edge, preferably at points corresponding to those of the slides at the upper edge. The non-separating slide is shaped so as to surround the upper portion of the lower track, and the separating slide is shaped so as not to engage the back wall of the lower track, while it on both sides surrounds the front wall of the lower track. In the wall of the lower track there is an aperture at the point where the separating slide is to separate from the lower track because of the pivoting movement.

In a preferred embodiment of the invention, one or both of the side panes are hinged to the side wall of the balcony. In general, however, only that side pane which is on the same side as the curved rail portion is hinged to the side wall, the other side pane being provided with slides at its upper and lower edges, as are the panes in the middle.

At the upper edge of the hinged side pane, preferably at the middle of the edge, there is a slide which is fitted to slide on a track fixed to the ceiling of the balcony, the track having the shape of a quadrant and running from the upper track to the side wall of the balcony. When the side pane is being detached from its hinges, for example, in order to be pivoted 180°, the slide sliding on the said track supports the pane.

At both ends of the upper edge of the hinged pane there are advantageously rollers rotating about their vertical axes. These facilitate the pivoting of the side pane 180° by rolling on the one hand against the side wall and on the other hand against the flange of the upper track .

According to a preferred embodiment of the invention there are seals at the upper and lower edges of the panes, preferably brush seals. The seal of the upper edge seals against the upper track in the horizontal direction and the seal of the lower edge seals against the lower track in the vertical direction. The upper edge has preferably seals which extend inwards and outwards, and at all times the one which extends towards the sealable part of the upper track will be in operation.

In the side walls of the balcony there are preferably butt seals against which the vertical edges of the side panes will settle so as to form a seal. Alternatively, the vertical edges of the side panes are provided with butt seals which will settle against the side walls so as to form a seal. Between the panes and between the panes and the side walls, vertical seals are provided. Vertical seals are disposed on the side walls of the balcony and on the vertical edges of every second pane between the side panes. The side panes themselves are not provided with vertical seals. Thus there is always a seal between two adjacent panes, regardless of how the pane is turned.

Balcony glazing thus formed is easy to manufacture and easy to install, and it is a very reliable structure which involves no reliability risks in its use or installation.

The panes are placed on one line, owing to which the vertical sealing can be carried out using small-scale and barely visible sealing. Actual frames are not needed if what is used is tempered or laminated glass or plastic sheets usable for such purposes.

The front wall of the balcony can be opened electively at any point, from 0 to 100%.

The panes can be assembled into a small cluster inside the balcony, at which time practically none of the glazing is visible from outside the building.

The panes pivot, supported on the tracks, in such a way that the washing of their outer surfaces can also be conveniently carried out from inside the balcony.

Supported by the track system, the panes can be pivoted 180°. Advantage can be taken of this by using as glazing a glass which reflects heat rays, so-called selective glass, which on one side lets through almost all heat rays of the sun and on the other side reflects a large proportion of the heat rays away from the pane. Thus it is possible, when so desired, to prevent the radiation of heat away from the balcony space or from the outside into the balcony space.

Figure 2:
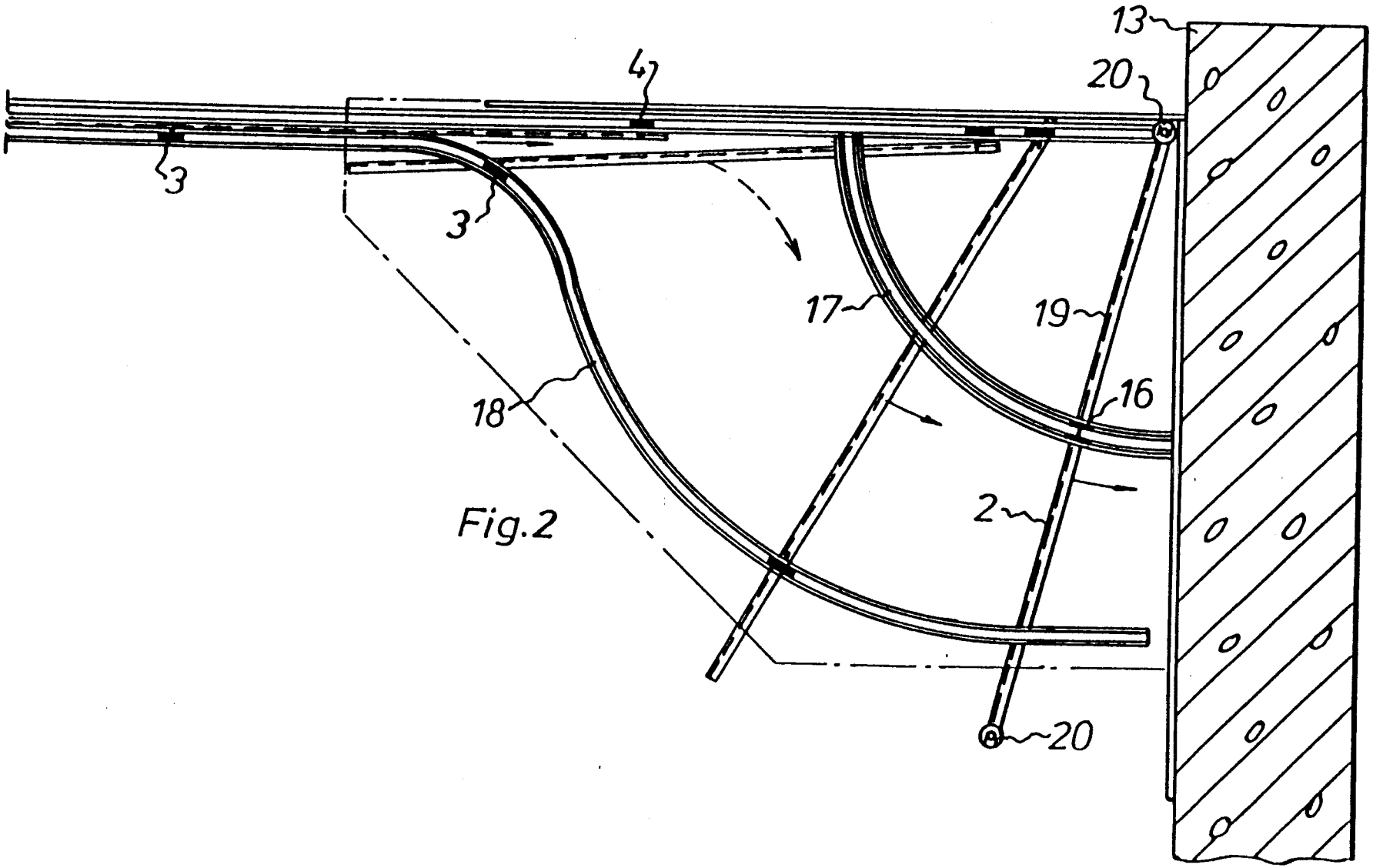
Figure 3:
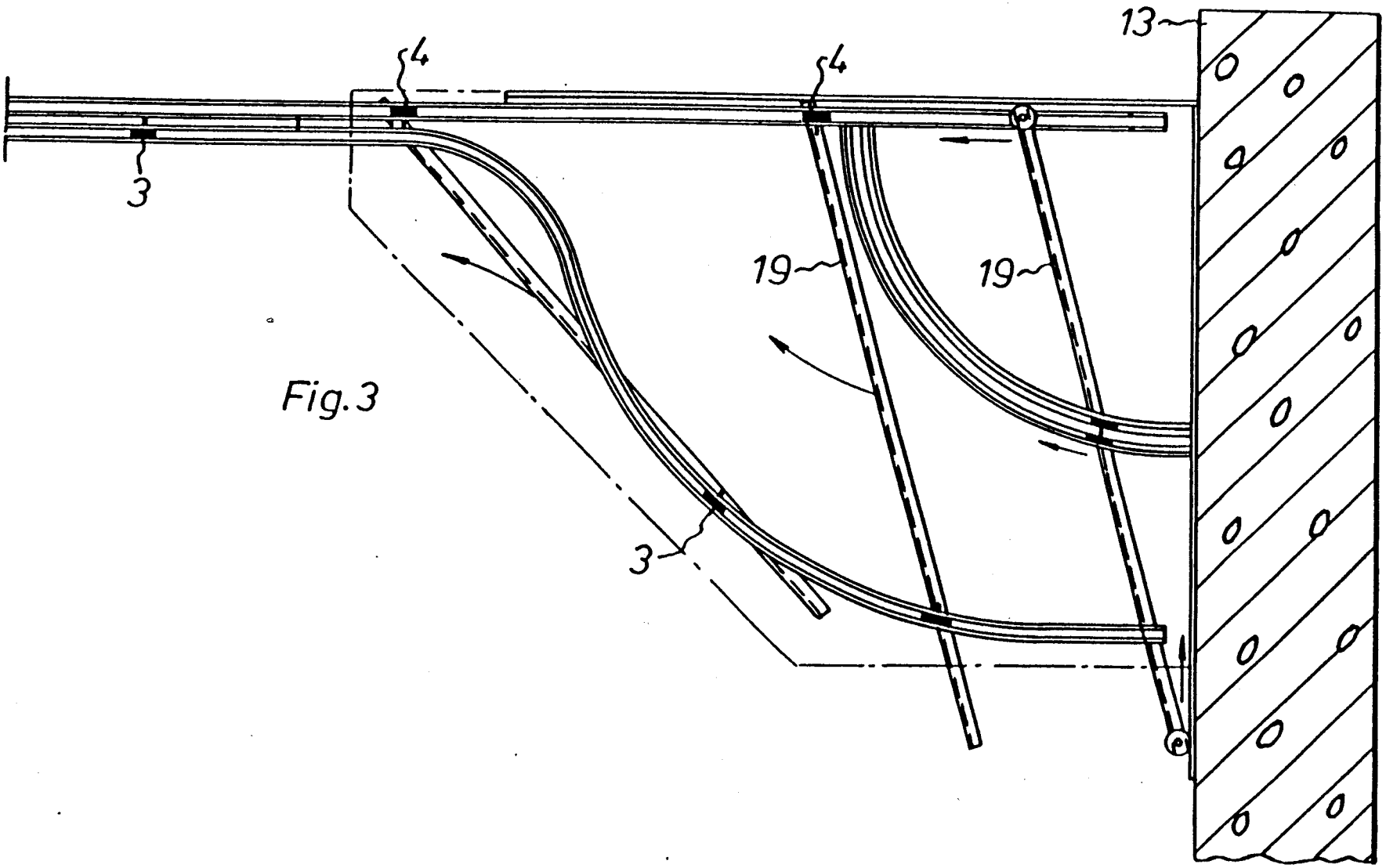

One preferred embodiment of the invention is described below in the form of an example, with reference to the accompanying drawings, in which FIG. 1 depicts a pivotable glazing of a balcony in the state in which it covers the balcony opening, FIG. 2 depicts the balcony ceiling, as seen from below, showing the side wall of the balcony, the upper track for the glazing, with its curved angle part, the bearing track for the hinged pane, and three different panes of glass at different positions of pivoting towards the open position, FIG. 3 depicts the same as FIG. 2, but the three different panes in different pivoting positions towards the closed position, FIG. 4 depicts a vertical section of a movable glass pane with its upper and lower profiles and its upper and lower tracks, FIG. 5 depicts a vertical section through the lower track and the non-separating slide, FIG. 6 depicts a vertical section through the lower track and the separating slide, FIG. 7 depicts a horizontal section of the seal between the non-hinged side pane and the side wall of the balcony, and FIG. 8 depicts a horizontal section of the seal between two adjacent panes of glass.

In the various figures the corresponding parts are indicated by the same reference numerals. The glazing shown in FIG. 1 comprises three panes; the left-side side pane and the middle panes being indicated by 1 and the right-side side pane, which is hinged, being indicated by 2. The slides at the upper edges of the movable panes 1, the slides being casters, are indicated by 3 and 4. The former is a caster moving on the inner rail and the latter a caster moving on the outer rail. The upper profile of the pane is indicated by 5 and the upper track by 6, and the hinge lock of the upper edge of the hinged pane by 7. Numeral 8 indicates the lower profile of a pane of glass and numeral 9 the lower track. Numeral **9*a* indicates an aperture in the flange of the lower track 9, through which aperture the slide 10*a* will separate when the pane pivots. The slides at the lower edges of the movable panes 1 are indicated by 10 and 10*a*. The slide 10 is a non-separating slide at the leading end of the lower edge, and slide 10*a* is the separating slide at the trailing end. Numeral 11 indicates the brush seal of the lower edge and numeral 12 the hinge lock of the lower edge of the hinged pane. Numerals 13, 14 and 15 indicate the balcony side wall, ceiling and the balustrade of the balcony in question and, respectively, of the balcony of the upper story. Numeral 16 indicates the bearing slide, which is a caster, of the hinged pane, and numeral 17 indicates the track, guiding the caster 16, of the hinged pane 2. Numeral 18 indicates the curved portion of the inner upper rail. Numeral 19 indicates the reflecting surface of the selective glass. Numerals 20 indicate the casters, at the ends of the upper edge of the hinged pane 2, facilitating the pivoting of the pane 180°. Numerals 21–24 indicate the various sealing parts so that 21 indicates the inside and outside brush seal of the upper edge of a pane, numeral 22 indicates the butt and seal strip in the side wall of the balcony, numeral 23 the butt and seal strip between panes, and numeral 24** the rubber seal which comes against the butt and seal strip.

During the cold season and at other times when it is desired to protect the inside space of the balcony from outside air, the panes 1 and 2 of the glazing are kept as shown in FIG. 1. When only a small airing aperture or the like is desired, the right-side hinged side pane 2 is opened inwards. In this case the roller 16 rolls in the suspension track 17 of the hinged pane 2. When it is desired to open a larger aperture, one or more of the other panes is moved to the right, whereupon they will pivot inwards when the trailing caster 3 comes within the curved portion of the inner rail, as shown in FIG. 2. A pane pivots inwards first slowly, then faster, and is finally pushed along the almost straight portion of the rail 18, towards the side wall. Thus one or more panes 1 will settle against the side pane 2 and the side wall 13. When turned inwards, the panes are also easy to wash. If a pane is of selective glass, it is possible to choose which side is the outside surface. It is easy to pivot the movable panes 1 in the area of the curved rail in such a manner that they will pivot 180°. When a pane 1 is in a position turned close to the side wall 13, its travel direction can be changed so that the leading edge, as shown in FIG. 3. FIG. 3 shows the panes after having been turned 180° from the state shown in FIG. 2. In FIG. 2 the reflecting glass surface is turned outwards and the upper slide 4, which is situated nearer to the curved rail 18, is leading the movement of the pane. In the turning area, defined by the curved inner rail 18, turning of the panes 180° is taking place, and the upper slide 4 is again leading the movement of the pane. Thus, the reflective surface of the pane has been turned inwards. Turning of the hinged side panes 2 take place by detaching the panes from their hinges and turning them 180° about their bearing casters 16 supported by the upper track 17. Thus the reflecting glass surface 19, which was previously outwards, will now be turned inwards.

The hinged pane can also be pivoted 180°. In this case the hinge locks 7 and 12 of the pane 2 are detached and the pane is pivoted, supported by its bearing caster 16, so that the hinged edge will slide along the upper track, while the opposite edge will slide along the side wall 13 of the balcony. After the pivoting, the previously free edge will be the hinged edge. The casters 20 at the upper edge of the hinged pane facilitate the pivoting by rolling along the flange of the upper track and along the side wall of the balcony.

As to the hardware, it can be mentioned that the casters 3 and 4, and the slides 10 and 10*a*, are mounted rotatably in the profiles 5 and 8 of the panes. The profiles of the upper and lower edges are preferably identical. The profiles have suitable fastening points for the different seals, and they have been designed so that rainwater cannot pass through the profile to inside the hardware but drips off. In the profiles 5 and 8, which are preferably identical, there are inner and outer flanges of different heights so that the fastening hole in the glass should be on one side uncovered and a corresponding hole would thus be easier to drill in the higher flange of the profile.

The upper track is double-grooved, forming thus an inner rail and an outer rail. The lower track is provided with flanges, being preferably a T rail. The inner flange has an aperture 9*a* at the point where the separating slide 10*a* separates from the track for pivoting. The slides 10 and 10*a* differ from each other so that the former has over its entire length the shape of an inverted U, surrounding the track 9, whereas the slide 10*a* lacks the rear flange but in its front flange there is added a hook-shaped piece which surrounds the inner flange of the track. The inner flange may also be turned upwards, in which case the front flange of the corresponding slide is straight. To the slide 10*a* there is additionally connected a lug-like handle by means of which the slide 10*a* can be turned 180° if the pane is pivoted 180°, in order for the slide to be in the correct position relative to the track 9. The caster 3 running on the upper inner rail is preferably always fixed at the same distance from the other caster 4, owing to which the shape of the curved portion of the inner rail is constant in all structures. The caster 4 moving on the outer rail is preferably at the edge of the pane so that the panes, when assembled on the side, will not extend outside the pane frame. The caster moving on the inner rail is at a constant distance from the caster 4. The distance between the caster 3 and the pane edge on that side is dependent on the width of the pane.

One embodiment of a pivotable glazing according to the invention is described above. It is, however, clear that the details of the hardware can be varied in a plurality of ways. When the pivotable glazing according to the invention is applied to a balcony which is not completely drawn in, it is clear that certain details must be designed in a different way. However, the panes which can according to the invention be pivoted and assembled inside the balcony constitute the main side of the invention and are present in all the various embodiments.

I claim:

1. A pivotable glazing for a balcony, comprising at least two movable panes, which are arranged to preferably cover the entire width of said balcony and to slide on a first upper track and a lower track secured to a ceiling and a balustrade of said balcony, respectively, an upper edge of each pane having a profile provided with at least two spaced upper slides, one of said at least two upper slides arranged to move along a straight outer rail of said first upper track and the other upper slide along an inner rail of said first upper track, said inner rail including a curved portion such that said inner rail turns inwards toward a side wall of said balcony, a lower edge of each pane having a profile provided with at least one first lower slide that is aligned with said one of said at least two upper slides which moves along said inner rail of said first upper track, said curved portion of said inner rail including a first portion starting from said straight outer rail and having a gently curving shape similar to the middle region of an inverted S-curve, a second portion continuing from the gentle curve to form a portion of a circular arc having a radius which generally corresponds to the distance between said at least two upper slides in said first upper track, and a third portion approximately parallel with said straight outer rail of said first upper track and extending to said side wall of said balcony, and a center point of said circular arc situated on said straight outer rail at a distance from said side wall of said balcony generally corresponding to said third portion of said inner rail , wherein at least one of said panes comprises a side pane which is hinged to said side wall of said balcony and which is provided with an upper middle slide arranged to move in a second upper track disposed in said ceiling and forming a smooth arc having a radius generally corresponding to one half of the width of said side pane, and said side pane being rotatable 180° about mounting means on said middle slide such that a face surface of said pane can be changed from having been turned inside to being turned outside and vice-versa.

2. A glazing according to claim 1 wherein said inner and outer rails of said first upper track are spaced apart from said side wall of said balcony such that said panes can be removed from said tracks.

3. A glazing according to claim 1 further comprising, at the lower edge of each pane, a second lower slide which is aligned with said one of said at least two upper slides which moves along said inner rail, and is separable from said lower track so as to enable said pane to pivot inwards.

4. A glazing according to claim 3, wherein said first lower slide not separating from the lower track is shaped so as to surround an upper portion of the lower track and that said second lower slide separating from the lower track is designed so as to surround only a front wall of the lower track and is thus able to separate from the lower track at an aperture in the front wall of the track.

5. A glazing according to claim 3, wherein said second lower slide separating from the lower track can be turned 180° relative to the pane surface.

6. A glazing according to claim 1 wherein at each end of an upper edge of said side pane there is at least one caster rotating about its vertical axis to facilitate the pivoting of said side pane.

7. A glazing according to claim 1 wherein at the upper edge of said panes there is a seal extending both outwards and inwards and that at the lower edge of said panes there is a seal extending downwards.

8. A glazing according to claim 7 wherein said seal is a brush seal.

9. A glazing according to claim 1 wherein in said side walls of said balcony there is mounted a seal against which a vertical edge of said panes settles so as to form a seal therebetween.

10. A glazing according to claim 1 wherein a vertical edge of some of said panes has a seal which settles against said side wall so as to form a seal therebetween.

11. A glazing according to claims 9 or 10 wherein said seal is a butt seal.

12. A glazing according to claim 9 or 10, wherein said panes are odd in number, said seal is not provided on the vertical edges of said at least one side pane, and every second pane adjacent said at least one side pane has said seal at both vertical edges thereof.

13. A glazing according to claim 12 wherein said seal is a butt seal.

* * * * *